United States Patent [19]

Janes

[11] Patent Number: 4,798,382

[45] Date of Patent: Jan. 17, 1989

[54] DOUBLE INVERTED BRIDGE TENNIS RACKET

[75] Inventor: Richard Janes, Belchertown, Mass.

[73] Assignee: Spalding & Evenflo Companies, Inc., Tampa, Fla.

[21] Appl. No.: 3,687

[22] Filed: Jan. 16, 1987

[51] Int. Cl.[4] ..... H63B 51/10

[52] U.S. Cl. ..... 273/73 C; 273/73 D

[58] Field of Search ..... 273/73 R, 73 C, 73 D, 273/73 E, 73 G; D21/210, 211, 212, 213

[56] References Cited

U.S. PATENT DOCUMENTS

| | | | |
|---|---|---|---|
| 2,171,223 | 8/1939 | Robinson | 273/73 |
| 2,220,935 | 11/1940 | LeCompte et al. | 273/73 |
| 2,456,023 | 12/1948 | Rosenbalm | 273/73 E |
| 2,626,804 | 1/1953 | Robinson | 273/73 |
| 2,878,020 | 3/1959 | Robinson | 273/73 |
| 3,751,034 | 8/1973 | Portz et al. | 273/73 D |
| 3,874,667 | 4/1975 | Gallagher et al. | 273/73 D |
| 4,076,241 | 2/1978 | Newsome | 273/73 D |
| 4,131,279 | 12/1978 | Ogden | 273/73 D |
| 4,141,551 | 2/1979 | Göransson | 273/73 G |
| 4,247,104 | 1/1981 | Goldsmith | 273/73 C |
| 4,408,760 | 10/1983 | Ferrari | 273/73 D |
| 4,437,662 | 3/1984 | Soong | 273/73 D |

FOREIGN PATENT DOCUMENTS

| | | | |
|---|---|---|---|
| 2263795 | 10/1975 | France | 273/73 D |
| 16414 | of 1891 | United Kingdom | 273/73 D |

*Primary Examiner*—Richard C. Pinkham
*Assistant Examiner*—William E. Stoll
*Attorney, Agent, or Firm*—Donald R. Bahr; John E. Benoit

[57] ABSTRACT

A midsize tennis racket is disclosed which utilizes two arcuate bridges, inverted with respect to the arc of the head of the racket, and includes grommets at opposite ends of the head in order to shorten the length of the center main string so as to provide more uniform power response in the central hitting area. A selected number of the center main strings are crisscrossed between the arcuate bridges and their support locations on the frame. The construction provides the playability of a small headed racket while maintaining the stability of a large headed racket. Further embodiments are disclosed which effectively shorten the length of the main strings by effectively creating two arcuate bridges. In one embodiment, the arcuate bridges are formed by elongated projections which have boreholes at their distal ends. In a further embodiment, inelastic loops are used to form the arcuate bridges. In a still further embodiment, U-shaped members are used with arms extending through the head, with the distal arms of the head being secured to the outer circumferential surface of the head.

5 Claims, 6 Drawing Sheets

DOUBLE INVERTED BRIDGE TENNIS RACKET

The present invention relates generally to tennis rackets and more particularly to tennis rackets having means for shortening the length of the center main strings.

BACKGROUND OF THE INVENTION

Most of the tennis rackets used today are designed with the main strings nearest the center of the racket being the longest in length with a gradual shortening of main string length as the main strings progress away from the longitudinal center of the racket.

As is well known, the longer the length of the main string, the more elastic (i.e. higher is the Coefficient of Restitution, C.O.R.).

The typical oval head-shaped racket in use today provides a greater C.O.R. than the round-headed rackets due to centralized location (i.e. no twist) and strength from the structural integrity and also permits the use of the longest main string length. This combination yields a large difference in C.O.R. as the ball is struck at various points on the racket, which occurs naturally during normal play.

The C.O.R., or power, in tennis rackets can also be increased by lowering string tensions. However, as string tension is lowered, there occurs a loss of control which affects the direction in which the ball may be hit. This greatly affects the playing ability of the racket itself.

The more experienced players use a tennis racket having a smaller head so as to increase the playability of the racket. Large headed rackets have been developed and are now on sale which increase the stability of the racket and, therefore, are much more usable by less experienced players.

It has been proposed in the past to improve the C.O.R. in tennis rackets as the ball impact departs from the longitudinal center line, that is, as it goes from side to side, by using a single inverted bridge in the throat of the racket, matching its contour with the contour at the top of the head. The purpose of this construction was to equalize the length of the main strings. While directionally correct, this construction was not sufficient to significantly improve off center performance, since C.O.R. falls off at a much faster rate. This is due to a combined effect of string length and moment of inertia of the racket about its longitudinal center line. What is required in order to significantly improve off center performance is to have the main strings increase in length as the impact point moves away from the center. This is the principal used in the present invention.

The present invention provides a racket which provides more uniformity with less than normal tension on the main strings. As a result of this, the racket provides less shock to the user, has a better life and has enhanced predictability. The racket of the present invention provides the playability of small headed rackets while still providing the stability of large headed rackets.

SUMMARY OF THE INVENTION

The present invention provides a mid-sized tennis racket which utilizes structure at opposite ends of the head in order to shorten the length of the center main strings so as to provide more uniform power response in the central hitting area. In the preferred embodiment, two arcuate bridges, which are inverted with respect to the arc of the head, are used, and selected number of the center main strings are criss-crossed between the inverted bridges and their support locations on the head. This criss-crossing shortens the effective elastic length of the center main strings. The racket construction of this invention entails the playability of the small headed racket while maintaining the stability of the large headed racket.

DETAILED DESCRIPTION OF THE DRAWINGS

Figure 1:
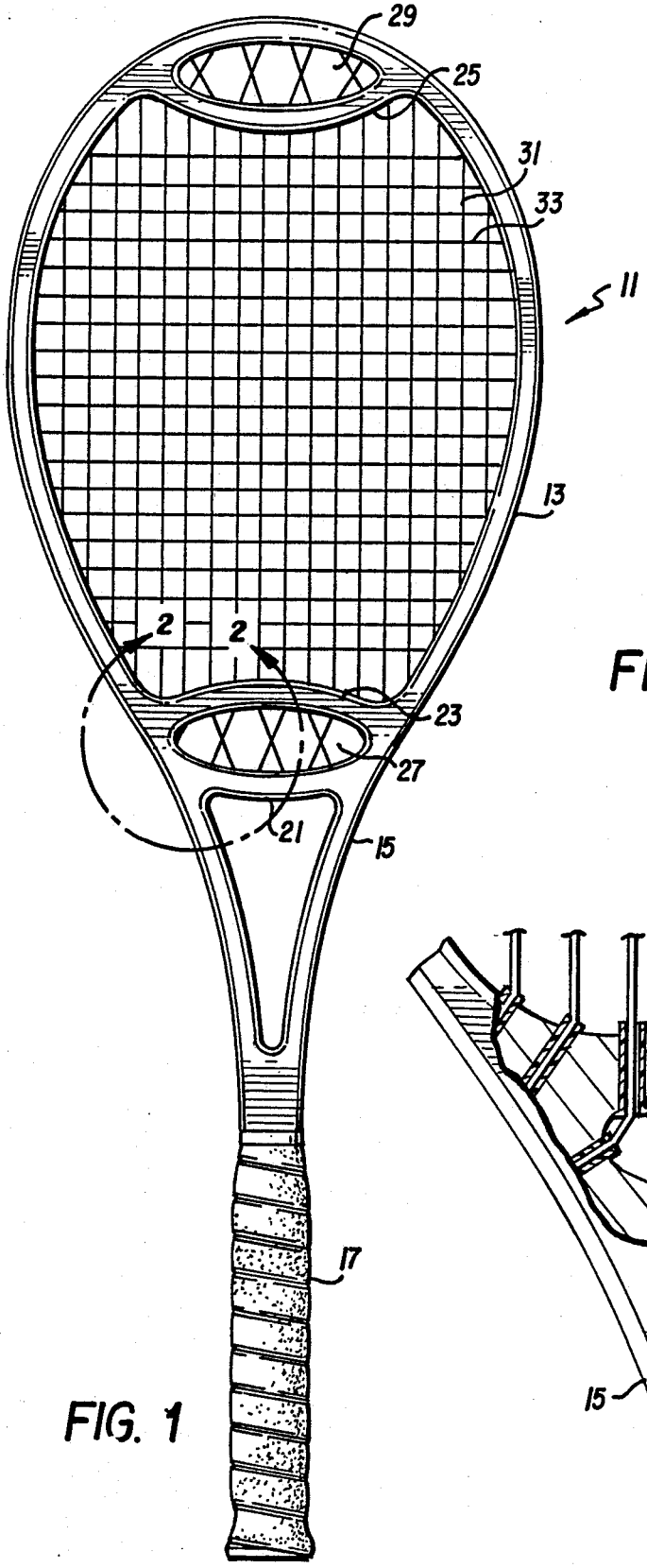
FIG. 1 is a plan view of one embodiment of the tennis racket of the present invention.

Before proceeding with the description of the racket as shown in the drawings, it should be noted that the power zone which is referred to herein constitutes the area of the racket (at least 1.5 inches inside the frame) wherein the coefficient of restitution is 0.35 or greater. The World Tennis Number is computed by: World Tennis Number$=0.3365\times$the area of the racket $-0.170$. This power zone is a standard in the tennis industry. The area which is used to arrive at the World Tennis number is the area, at least 1½" inside the racket frame, wherein the coefficient of restitution is at least 0.35. The World Tennis number is an arbitrary number which was adopted by World Tennis in order to reduce the power zone to a number between 1 and 10. To arrive at this number, the area in square inches (without the unit "square inches") is multiplied times 0.3365, and 0.170 is subtracted from the product of this multiplication. The resultant number is referred to as the World Tennis number. This number relates to the power zone wherein the coefficient of restitution is at least 0.35, as described above.

It is also to be understood that the drawings are schematic illustrations as far as the strings of the racket are shown, since all normal strings have not been shown for purposes of clarity. The normal crossing relationship between the longitudinal and transverse strings is used in the present invention.

Turning now to the preferred embodiment of FIG. 1, there is shown a substantially oval headed tennis racket 11 comprising a head 13, a throat 15 and a handle with grip 17. Also shown is bridge 21 at the throat 15 which effectively is part of the oval head.

An arcuate bridge 23, inverted with respect to the arc of the head, between opposite sides of the head above the bridge 21 and into the head area so as to create open area 27 therebetween. Likewise, at the top of the head of the racket, a further inverted arcuate bridge 25 extends into the head area and creates open area 29.

The central portion of the racket contains the usual stringing of main strings 31 and cross strings 33. However, the central main strings which, in the illustration consists of eight of the main strings, extend through the inverted bridges 23 and 25 and are strung such that the strings extend through and bear against the ends of the grommets within open areas 27 and 29. In order to assure such contact, selected adjacent main strings are criss-crossed with each other with the openings before passing through the main frame.

Figure 3:
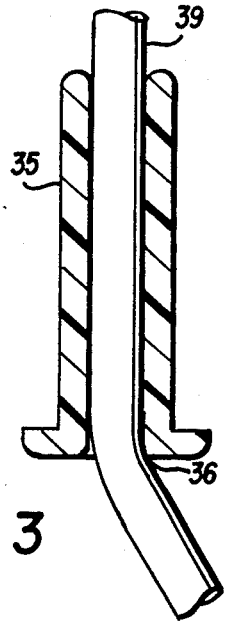
FIG. 3 is a magnified view of one of the grommets and strings as used within the inverted bridge of FIG. 2.
Figure 2:
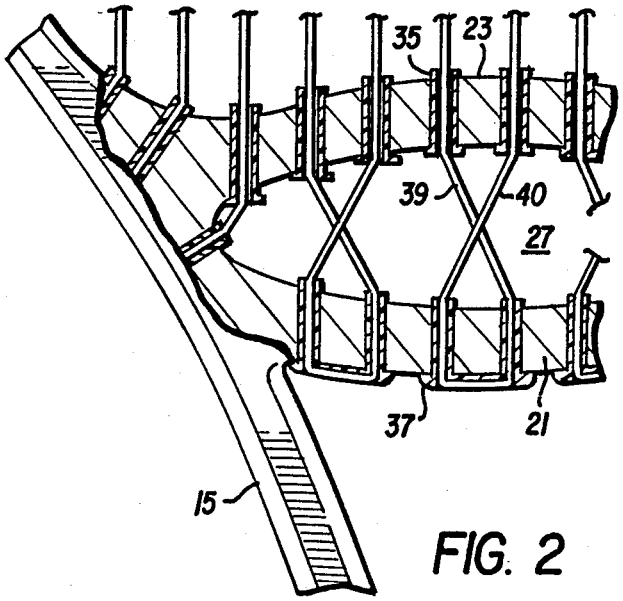
FIG. 2 is a partial cross-sectional view taken along the lines 2—2 of FIG. 1.

FIG. 2 discloses the details of the stringing of the racket of the present invention in a more clearly defined enlarged view. As can be seen in FIG. 2, a plurality of grommets 35 extend through inverted bridge 23. One-piece grommet strips 37 are inserted through the bridge 21 so that the racket may be properly strung. The main strings which pass through the open area 27, such as main strings 39 and 40 are criss-crossed between the inverted bridge 23 and the bridge 21. The outer strings pass at an angle between inverted bridge 23 and bridge 21. This construction assures that the support of the main string occurs at the head portion of the racket rather than directly bearing upon the inverted bridge 23. It also assures that each string frictionally bears against the associated grommet in the inverted bridge. The upper inverted bridge is strung in the same manner. While the criss-crossing of the strings substantially prevents movement of the main strings through the grommets, the frictional force against the grommets created by such criss-crossing effectively shortens the vibrational length of the main string to that distance between the upper and lower inverted bridges. This can be more clearly seen in FIG. 3 which shows that main string 39 passes through grommet 35 and bears firmly against corner 36 of the grommet.

The preferred construction of the racket is to use conventional 100% graphite since the inverted bridge at the top and bottom of the bow are the only unconventional part of the construction. The 100% graphite construction is preferred in order to maintain adequate strength and power along with proper weight and balance. Weight and balance are of particular concern because of the mass of the two additional bridge means utilized in the present invention.

The preferred distance along the center line between the two inverted bridges is from about 9.0 inches to about 15.0 inches. The preferred range of distance is form about 9.0 inches to about 12.0 inches with the preferred distance being substantially 10 inches.

With a racket having a surface area of from about 80 to about 85 square inches, the preferred range for string tension for the racket of the present invention is from about 50 to about 70 pounds with a preferred range of tension as being from about 50 to about 60 pounds and the preferred tension being substantially 57 pounds. It is understood by one skilled in the art that the string tension will vary with the head size. Normally, the larger the head size, the higher the string tension, and the smaller the head size, the lower the string tension.

This points up an additional advantage of the shorter main strings in that lower string tensions can be used to obtain the same playability as smaller headed rackets without incurring a trampoline effect. This makes the racket easier and safer to string and results in less string and grommet wear and tear during play.

Figure 4:
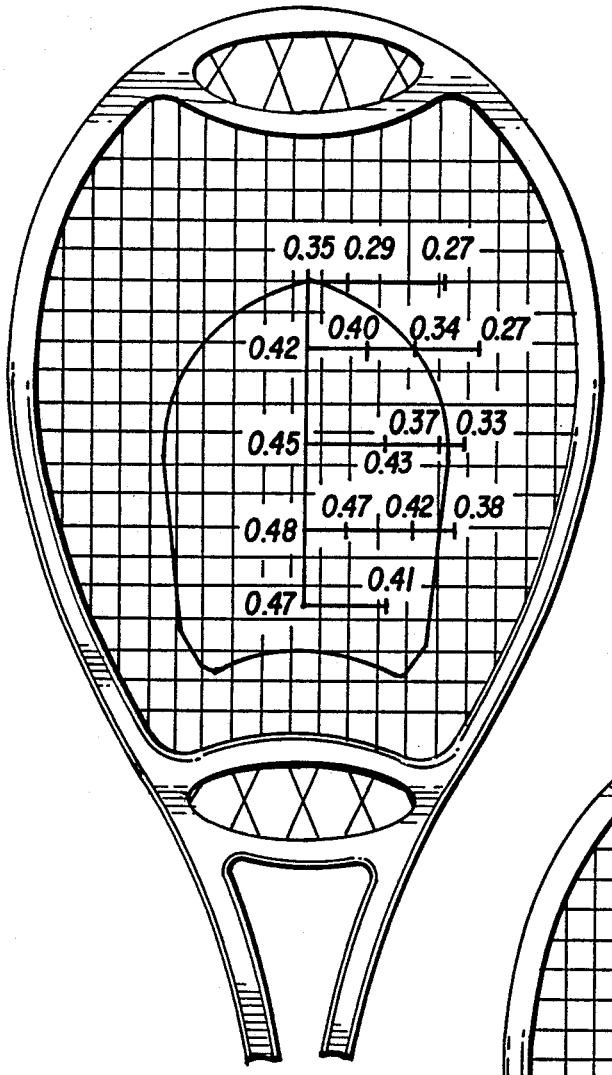
FIG. 4 is a schematic illustration of the racket of FIG. 1 indicating the power zone.
Figure 5:
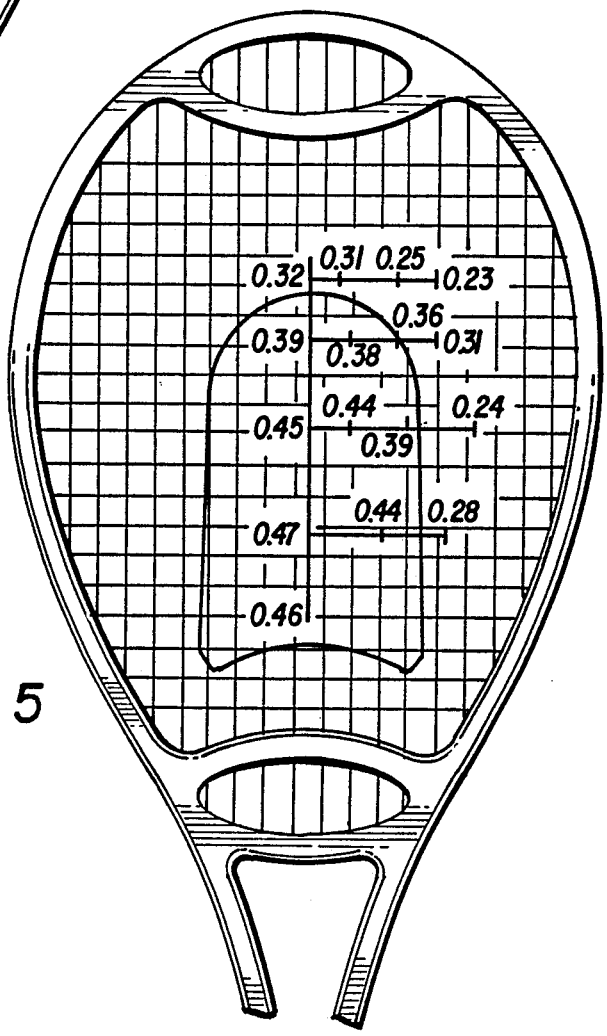
FIG. 5 is a schematic illustration of the racket of FIG. 1 having the strings passing directly through the grommets to the frame and indicating the power zone.
Figure 6:
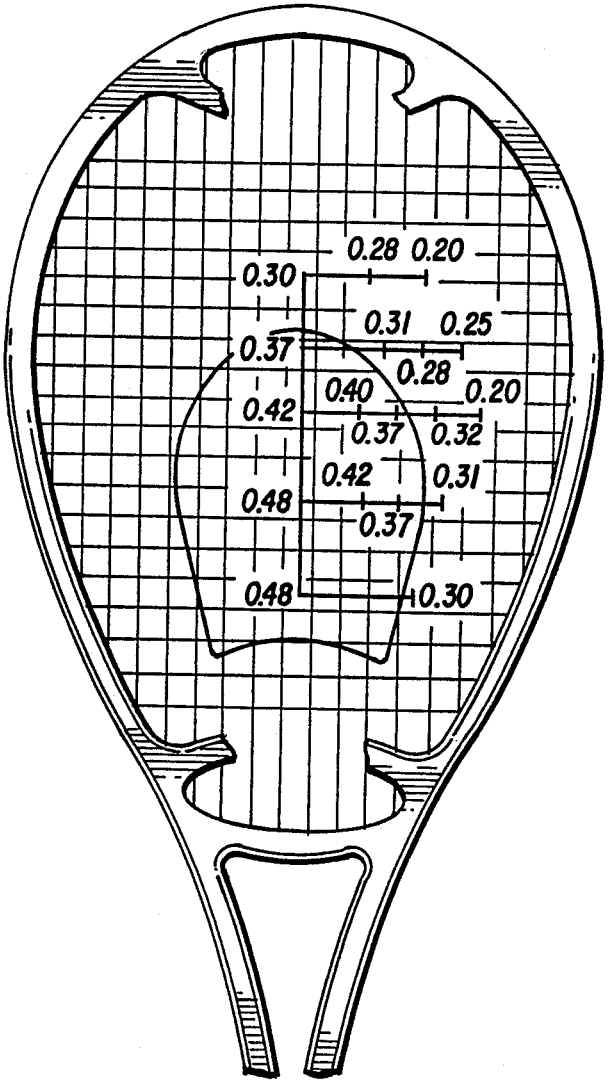
FIG. 6 is a schematic illustration of the racket of FIG. 1 with the inverted bridges removed and indicating the power zone.

The results obtained by the present racket are illustrated in the diagrammatic representations of FIGS. 4 through 6. FIG. 4 is an illustration of a double inverted bridge oval-headed racket which is strung in accordance with the present invention, as shown in FIG. 1. FIG. 5 illustrates a racket which is identical to the racket of FIG. 4 except that the effective length of the center strings is allowed to proceed freely through the double inverted bridges to the frame. FIG. 6 illustrates the racket of FIG. 4 wherein the inverted bridges have been cut away.

Comparing FIGS. 4, 5, and 6, it can be seen that the power zone of the racket of FIG. 4 is substantial, namely 8.2. In the racket of FIG. 5, the power zone is reduced to 6.9. In the racket of FIG. 6, the power zone has been further reduced to 5.8. This illustrates that the double inverted bridge alone increases the power zone and that the string arrangement of FIG. 4 further increases the power zone. The tests illustrated in FIGS. 4 through 6 were conducted in the same manner for all rackets.

As will be obvious, the main strings of the racket of the present invention are shortest (have less C.O.R.) in the center and gradually get longer towards the outside. This adaptation alone would even out the C.O.R. across the racket face resulting in a much more equal C.O.R. albeit a much lower/less powerful C.O.R. for shots hit in the central area. However, in the present invention, the string tension is reduced to adjust ball response to a custom feel with normal string length. This adds the benefit of raising the C.O.R. to the original (or higher) C.O.R. values of a conventional racket of similar overall bow size.

The restitution of C.O.R. values is accompanied by several improvements over a normal racket of similar bow size/shape without the double inverter bridges of the present invention.

Such improvements are:

(a) Restored power is more evenly spread over the width of racket strung area.
(b) Lower string tension yields lower shock to the player.
(c) Lower string tension is easier to string.
(d) Lower string tension produces less strain on the racket frame.
(e) Lower string tension produces less strain on the string, thus resulting in a longer string line.
(f) Lower string tension means it is safer to string with gut, which breaks at much lower tensions than does synthetic material.
(g) Due to a more even C.O.R. zone, even lower string tensions can be used, improving spin production and providing even, high C.O.R. output.
(h) Due to the increased structural integrity of the loop by the addition of the double inverted bridge, flexion during stringing and flexion during ball impact are reduced significantly. This increases the strength to the upper strung head area, effectively raising the area of the power zone to a higher position in the head. The lower string tension overall also aids in increasing all ranges of the power zone area, including raising the power zone area to higher parts of the head strung area.

FIGS. 7 and 7*a*, 8 and 8*a*, 9–9*c* and 10–10*c* illustrate further modifications which may be used to shorten the central main strings of the racket so as to achieve the above discussed advantages. Each of these structures effectively creates an inverted bridge configuration by providing inverted arcuate string retaining means. Accordingly, the above-discussed results apply equally to these modifications.

Figure 7:
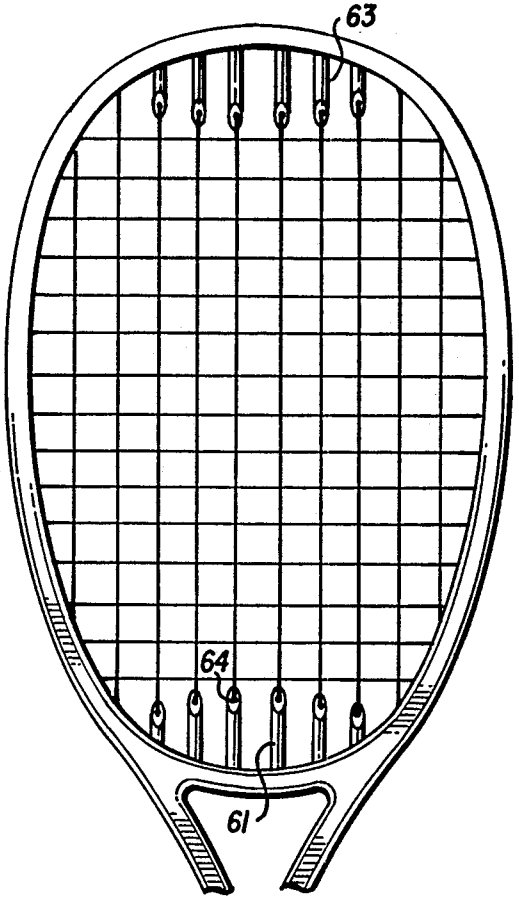
Figure 7A:
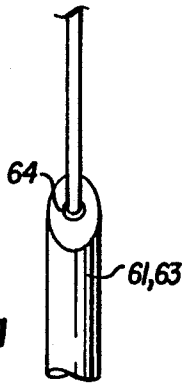

In FIG. 7, elongated projection 61 and 63 are integral with and extend within the bow and have boreholes 64 extending therethrough. FIG. 7*a* is an enlarged view of a single projection, the projections being the same at the top and bottom of the racket. The projections are of a length so as to create the same shortening of the central main strings as do the inverted bridges of FIG. 1.

Figure 8:
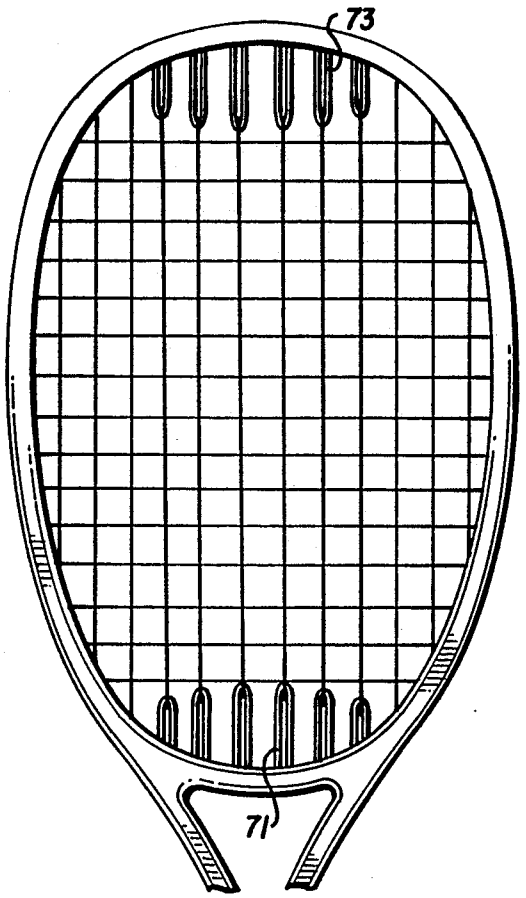
FIGS. 7 through 10 are illustrations of further embodiments of the present invention.
Figure 8A:
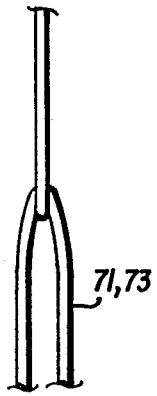

In FIG. 8, inelastic loops 71 and 73 extend from the frame into the bow to provide for stringing of the central main strings. FIG. 8*a* is an enlarged view of a single loop, the loops being the same at the top and bottom of the racket. Again, these loops are of a length to create the same shortening of the central main strings as do the inverted bridge of FIG. 1.

Figure 9:
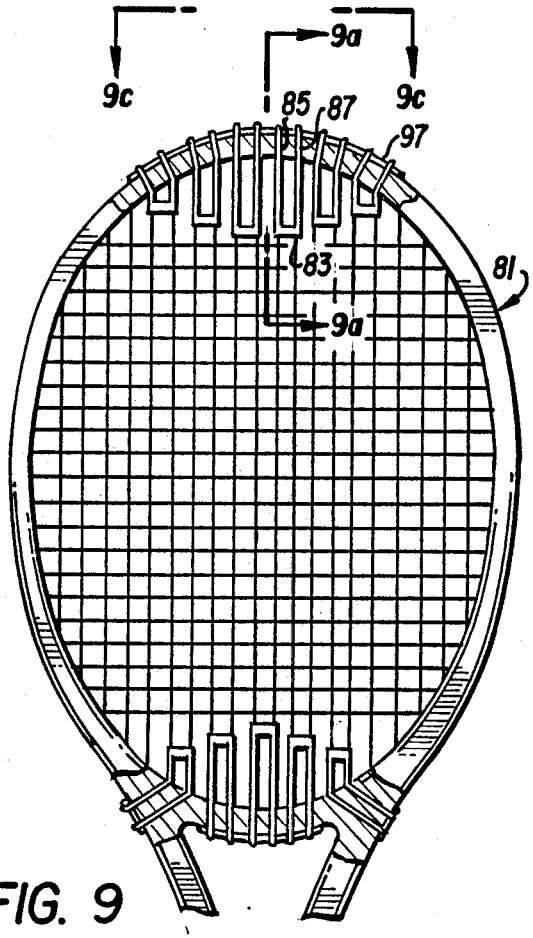
Figure 9A:
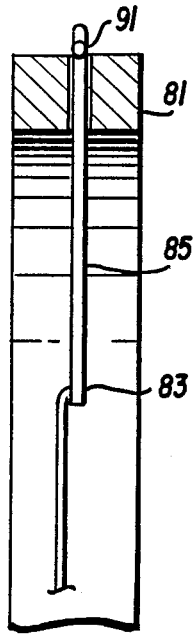
Figure 9B:
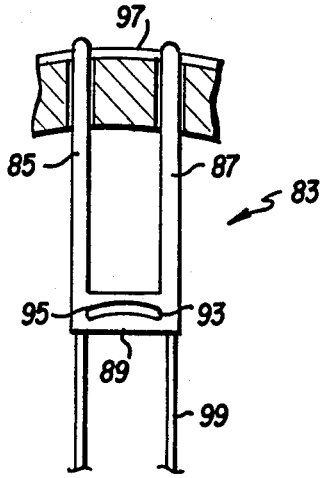

Turning now to FIG. 9, there is shown a further modification of a tennis racket which provides the effect of the double inverted bridge described above. In this embodiment, frame 81 is shown as including U-shaped inserts 83 of varying lengths. These inserts each have arms 85 and 87, which are integral with cross-member 89. Arms 85 and 87 pass through string holes in the racket frame and extend outwardly therefrom, as more clearly shown in FIGS. 9*a*, 9*b*, and 9*c*. Each of the arms has an orifice 91 through the terminal ends thereof which extend above the outer edge of frame 81. This permits the passage of a strip 97 through all of the orifices so as to hold the U-shaped inserts in place, as shown.

Figure 9C:
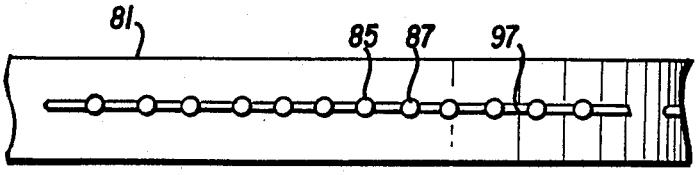

Cross-member 89 has string holes 93 and 95 which permit stringing of the racket with strings 99, as illustrated. When the racket is fully strung, the partial top view of FIG. 9*c* shows the position of arms 85, 87 and strip 97.

As will be obvious from the illustrations, the U-shaped inserts are of a length so as to create the same shortened effect of the central main strings as does the inverted bridge described above.

Figure 10:
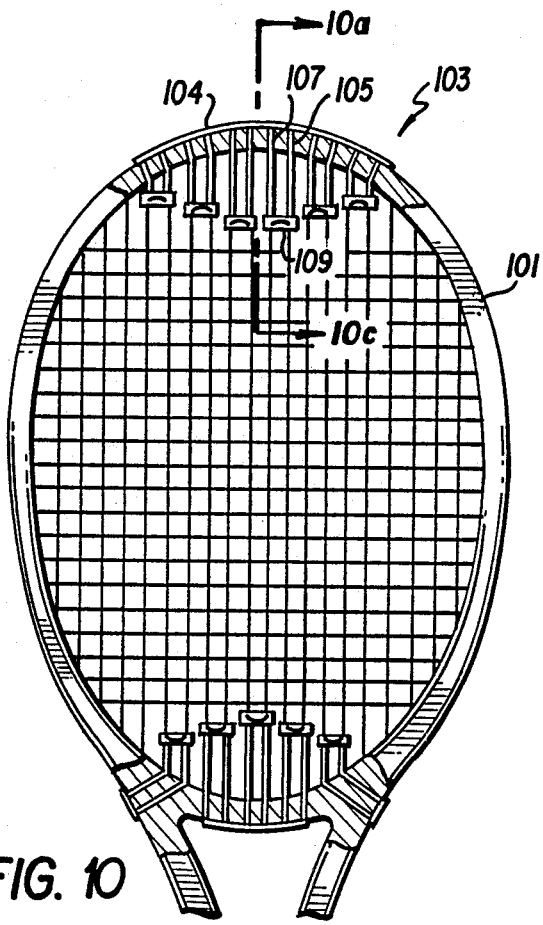
Figure 10A:
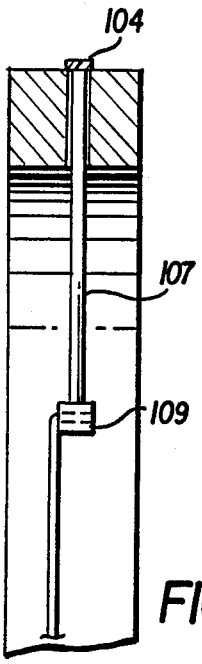
Figure 10B:
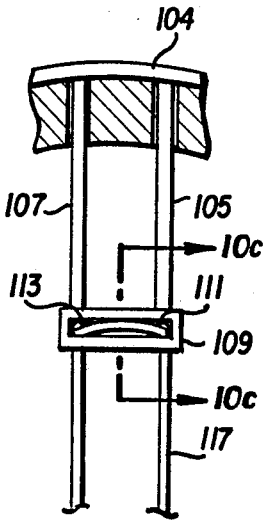
Figure 10C:
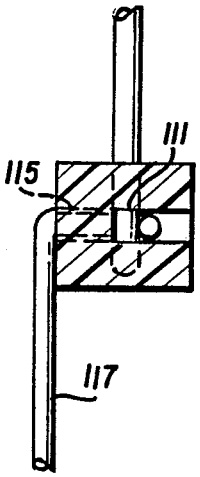

Referring now to FIGS. 10 and **10*a*–10*c*, there is shown a further modification of the present invention. Racket frame 101 is shown as containing insert 103, such insert including a base 104 with a plurality of integral arms 105, 107 extending downwardly therefrom. Arms 105 and 107 and all of the other arms shown are of a semi-flexible nature, as is the base 104, so that the arms may be passed through the string holes of the racket in the manner as shown. The arms are shown as mating with separate spacers 109, which spacers pass over the end of the arms. Each of the arms has an orifice 111 in the terminal end thereof, such orifice being large enough to accept the racket string. Each spacer 109 includes slot 113 in one face thereof and orifices 115** which extend from the slot rearwardly, as shown in FIG. 10*c*. Orifices 115 are mated with orifices 111 in the arms when the spacer is placed over the ends of the arms. When the spacer is in place, string 117 is strung through orifice 111, across channel slot 113 and through the mating orifices in the other arm and spacer.

Again, insert 103, being an integral, semi-flexible device, is designed such that the lengths of the arms vary as shown. This will provide the effective shortening of the main strings as does the inverted bridge of the previously discussed embodiments.

The above description and drawings are illustrative only since modifications of the structure described and illustrated could be modified without departing from the invention, the scope of which is to be limited only by the following claims.

I claim:

1. A tennis racket comprising a substantially oval head including a plurality of main strings and cross strings;

a handle;

a throat interconnecting said head and said handle, said head, throat, and handle lying in a common plane;

a first arcuate bridge connected to said oval head adjacent said throat and extending within said oval head and lying in said common plane;

a second arcuate bridge connected to said head and extending within said head opposite said first arcuate bridge and lying within said common plane;

a preselected number of grommets extended through each of said first and second arcuate bridges; and a preselected number of said main strings passing through said grommets in said first and second arcuate bridges and supported at said frame, a selected number of said preselected main strings being crisscrossed between said first arcuate bridge and said frame and between said second arcuate bridge and said frame.

2. The tennis racket of claim 1 wherein said frame, handle and said first and second arcuate bridges are of an integral construction.

3. The tennis racket of claim 2 wherein said racket is of graphite.

4. The tennis racket of claim 1 wherein the radius of curvature of said first and second arcuate bridges are substantially equal.

5. The tennis racket of claim 1 wherein eight of said main strings pass through said grommets in said first and second arcuate bridges.

* * * * *